US006007907A

United States Patent [19]

Wolf

[11] Patent Number: 6,007,907

[45] **Date of Patent: *Dec. 28, 1999**

[54] COMPOSITE JEWELRY STONE

[76] Inventor: Steven J. Wolf, 161 E. 79th St., New York, N.Y. 10021

[ * ] Notice: This patent is subject to a terminal disclaimer.

[21] Appl. No.: 09/133,048

[22] Filed: Aug. 13, 1998

Related U.S. Application Data

[63] Continuation-in-part of application No. 08/866,503, May 30, 1997.

[51] Int. Cl.[6] ..... B32B 5/16

[52] U.S. Cl. ..... 428/323; 428/15; 63/28; 63/29.1; 63/32

[58] Field of Search ..... 428/15, 323; 63/28, 63/29.1, 32

[56] References Cited

U.S. PATENT DOCUMENTS

| | | | |
|---|---|---|---|
| D. 48,499 | 2/1916 | Robbins | D11/90 |
| D. 68,641 | 11/1925 | Robbins | D11/34 |
| D. 68,642 | 11/1925 | Robbins | D11/34 |
| D. 68,644 | 11/1925 | Robbins | D11/34 |

(List continued on next page.)

FOREIGN PATENT DOCUMENTS

| | | |
|---|---|---|
| 859885 | 9/1940 | France . |
| 1120076 | 6/1956 | France . |
| 1015310 | 12/1965 | United Kingdom . |

OTHER PUBLICATIONS

Photocopy of advertisement, "The Magic of Printillion® only from Orion", *Modern Jeweler,* May 1998, 3 pages, Orion Diamond Inc.

Photocopy of "JCK What's New", *Jewelers' Circular–Keystone,* Feb. 1990, p. 192.

Photocopy of diamond necklace from Christies Catalog, undated, p. 214.

"*Diamond Cutting*", 4th Ed., by Basil Watermeyer, definition of "Trilliant", 1960.

"Designer DiamondS The Contemporary Shapes of Designer Diamond Jewelry", *JQ Jewelers quarterly,* 1st quarter, 1987, pp. 18 and 19.

"The Trillion", *Diamond World Review,* Summer 1980, pp. 920–923.

"Dresden Green Diamond", *Gems & Gemology,* Winter 1990, p. 258.

"Jewellery", *Sotheby's Art At Auction,* 1980–1981, p. 254.

Unidentified photocopy, Rizzoli International Publications, Inc., p. 168 and unnumbered page (admitted prior art).

Éclat Paris International No. 23, 1992, 1 page.

Declaration of Leda Taveras, dated Jan. 6, 1997.

Declaration of Robert Wueste, dated Jan. 6, 1997.

"A Blazing Display of Brilliant designs Evoking the Future Yet Suited For Today", Paul Klecka, Inc., p. 53, admitted prior art.

Declaration of Stanley Doppelt, dated Nov. 14, 1996.

Declaration cf Michael Schacter, dated Dec. 31, 1996.

Declaration of David Spivak, dated Jan. 6, 1997.

*Primary Examiner*—Deborah Jones
*Assistant Examiner*—Abraham Bahta
*Attorney, Agent, or Firm*—Akin, Gump, Strauss, Hauer & Feld, L.L.P.

[57] ABSTRACT

A composite stone which includes a first half-stone having a mating edge with a first length and a second half-stone having a mating edge with a second length which is approximately equal to the first length is provided. At least a first baguette and a second baguette are mounted between the first and second half-stones. Each of the at least first and second baguettes has a first mating edge and a second opposing mating edge which have a third length that is approximately equal to the first length. The first mating edge of the first baguette is generally aligned with the mating edge of the first half-stone. The second mating edge of the second baguette is generally aligned with mating edge of the second half-stone. The second mating edge of the first baguette faces the first mating edge of the second baguette.

16 Claims, 7 Drawing Sheets

U.S. PATENT DOCUMENTS

| | | | |
|---|---|---|---|
| D. 68,931 | 12/1925 | Robbins | D11/34 |
| D. 71,325 | 10/1926 | Bornkessel | D11/34 |
| D. 71,326 | 10/1926 | Bornkessel | D11/34 |
| D. 85,237 | 9/1931 | Gross | D11/34 |
| 138,314 | 4/1873 | Bruhl | 63/32 |
| D. 139,667 | 12/1944 | Klein | D11/26 |
| D. 196,868 | 11/1963 | Nagy . | |
| D. 250,100 | 10/1978 | Finker et al. | D11/90 |
| D. 262,300 | 12/1981 | Lundy | D21/534 |
| D. 276,143 | 10/1984 | Williams | D11/90 X |
| D. 324,003 | 2/1992 | Baranes | D11/90 |
| D. 334,154 | 3/1993 | Benderly | D11/90 |
| D. 338,851 | 8/1993 | D'Haene | D11/90 |
| D. 350,708 | 9/1994 | Bachar | D11/90 |
| D. 372,204 | 7/1996 | Itzkowitz | D11/34 |
| D. 372,883 | 8/1996 | Adler | D11/89 |
| D. 373,971 | 9/1996 | Katz | D11/90 |
| D. 374,193 | 10/1996 | Doustorian | D11/34 |
| 948,774 | 2/1910 | Strelitz | 63/28 |
| 954,568 | 4/1910 | Gebhardt | 63/28 |
| 1,134,497 | 4/1915 | Abel et al. | 63/28 |
| 1,171,186 | 2/1916 | Frackman | 63/28 |
| 1,204,915 | 11/1916 | Whitehouse | 63/28 |
| 1,204,916 | 11/1916 | Whitehouse | 63/28 |
| 1,204,917 | 11/1916 | Whitehouse | 63/28 |
| 1,205,113 | 11/1916 | Selmeier | 63/28 |
| 1,252,966 | 1/1918 | Suderov | 63/28 |
| 1,276,132 | 8/1918 | Suderov | 63/28 X |
| 1,308,011 | 6/1919 | Gilsey | 63/26 |
| 1,322,062 | 11/1919 | Schumer et al. | 63/28 |
| 1,325,315 | 12/1919 | Cresse | 63/28 |
| 1,330,993 | 2/1920 | Whitehouse | 63/28 |
| 1,332,206 | 3/1920 | Dinhofer | 63/28 |
| 1,929,236 | 10/1933 | Bridler | 63/15 |
| 2,035,244 | 3/1936 | Pejchar | 63/26 |
| 2,207,869 | 7/1940 | Monnier | 63/28 X |
| 2,729,955 | 1/1956 | Jay | 63/15.3 |
| 2,907,187 | 10/1959 | Karp et al. | 63/28 |
| 3,394,692 | 7/1968 | Sirakian | 63/28 |
| 4,503,687 | 3/1985 | Tessler et al. | 63/28 |
| 5,072,601 | 12/1991 | Slowinski | 63/28 |
| 5,123,265 | 6/1992 | Ramot | 63/28 |
| 5,533,364 | 7/1996 | Freilich | 63/28 X |

COMPOSITE JEWELRY STONE

CROSS REFERENCE TO RELATED APPLICATIONS

This application is a continuation-in-part of U.S. Application Ser. No. 08/866,503, filed May 30, 1997, which is incorporated herein by reference as if fully set forth herein.

BACKGROUND OF THE INVENTION

The present invention relates to a novel arrangement of precious stones, and more particularly, to the arrangement and setting of four or more precious stones, such as diamonds, in a manner which provides the appearance of a single larger marquise, navette or other shaped stone.

Precious stones such as diamonds have varying commercial and esthetic value depending, among other factors, on their color, clarity, cut, and size. While color, clarity and cut are important factors in the marketability of a gem or setting, the size of a gem contributes greatly to the purchaser's perception of value and desirability. Ordinarily, in order to present a large viewable surface of a precious stone such as a diamond, it is necessary to employ a large stone. This can entail a considerable expense. Unfortunately, some natural gem stones are not readily available in sufficient quantity in the desired larger sizes to meet the market demand or, if available, are prohibitively expensive in the larger sizes. As a result, certain types of larger stones, such as emeralds, are now man made. However, this solution is not practical with diamonds. Additionally, consumers generally prefer natural gem stones over artificial ones, so the creation of man made stones, where possible, does not address this problem.

One known solution is to employ settings that hold two smaller stones together to provide the appearance of a single larger stone. A combination of smaller stones costs less than a single larger stone having the same total weight, and there is less loss of stone in the cutting process. This known technique has been attempted by the present inventor and others for producing so-called Marquise or Navette stones.

One known technique for constructing a composite marquise or navette stone has been to assemble two half-marquise stones, base-to-base, giving the appearance of a contiguous whole. The composite stone created by this method is, however, limited based on the geometry and proportions of the resulting assembled stone, as well as by the cost and availability of suitable stones for cutting larger half-marquise or other types of stones. It would therefore be desirable to create a composite stone of a larger size than that produced using two half-stones in order to satisfy the demands of the market.

Some prior attempts to assemble smaller stones into a larger contiguous whole have not been entirely successful in that the assembled stones often exhibit a dark band or zone in the region of the juncture between stones and/or include joints which are apparent. Additionally, dust and dirt particles become wedged between the stones when the joints are apparent. These disadvantages detract from the value and beauty of the assembled stones.

Prior attempts to eliminate these undesirable qualities have not been entirely successful. One reason for this lack of success is that the marquise-halves or escutcheons are generally elliptical stones, and the same basic cutting methods have been applied to them as have been used for the "brilliant" cutting of generally circular stones. This generally resulted in "dark zones" in the assembled stones because of less than optimal light reflection.

SUMMARY OF THE INVENTION

Briefly stated, the present invention provides a composite jewelry stone. The composite stone includes a first half-stone having a mating edge with a first length and a second half-stone having a mating edge with a second length which is approximately equal to the first length. At least a first baguette and a second baguette are mounted between the first and second half-stones. Each of the at least first and second baguettes has a first mating edge and a second opposing mating edge which have a third length that is approximately equal to the first length.

The first mating edge of the first baguette is generally aligned with the mating edge of the first half-stone. The second mating edge of the second baguette is generally aligned with mating edge of the second half-stone. The second mating edge of the first baguette faces the first mating edge of the second baguette.

In another aspect, the present invention provides a composite jewelry stone which includes a first half-stone having a mating edge with a first length. A second half-stone having a mating edge of a second length which is approximately equal to the first length is also provided. At least first and second baguettes are mounted between the first and second half-stones. Each of the at least first and second baguettes has a first mating edge and a second, opposing mating edge, each of which has a third length. The sum of the third lengths of the at least first and second baguettes is approximately equal to the first length. The first mating edges of each of the at least first and second baguettes are generally aligned with the mating edge of the first half-stone. The second mating edges of each of the at least first and second baguettes are generally aligned with the mating edge of the second half-stone.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figures 1, 2, 3:
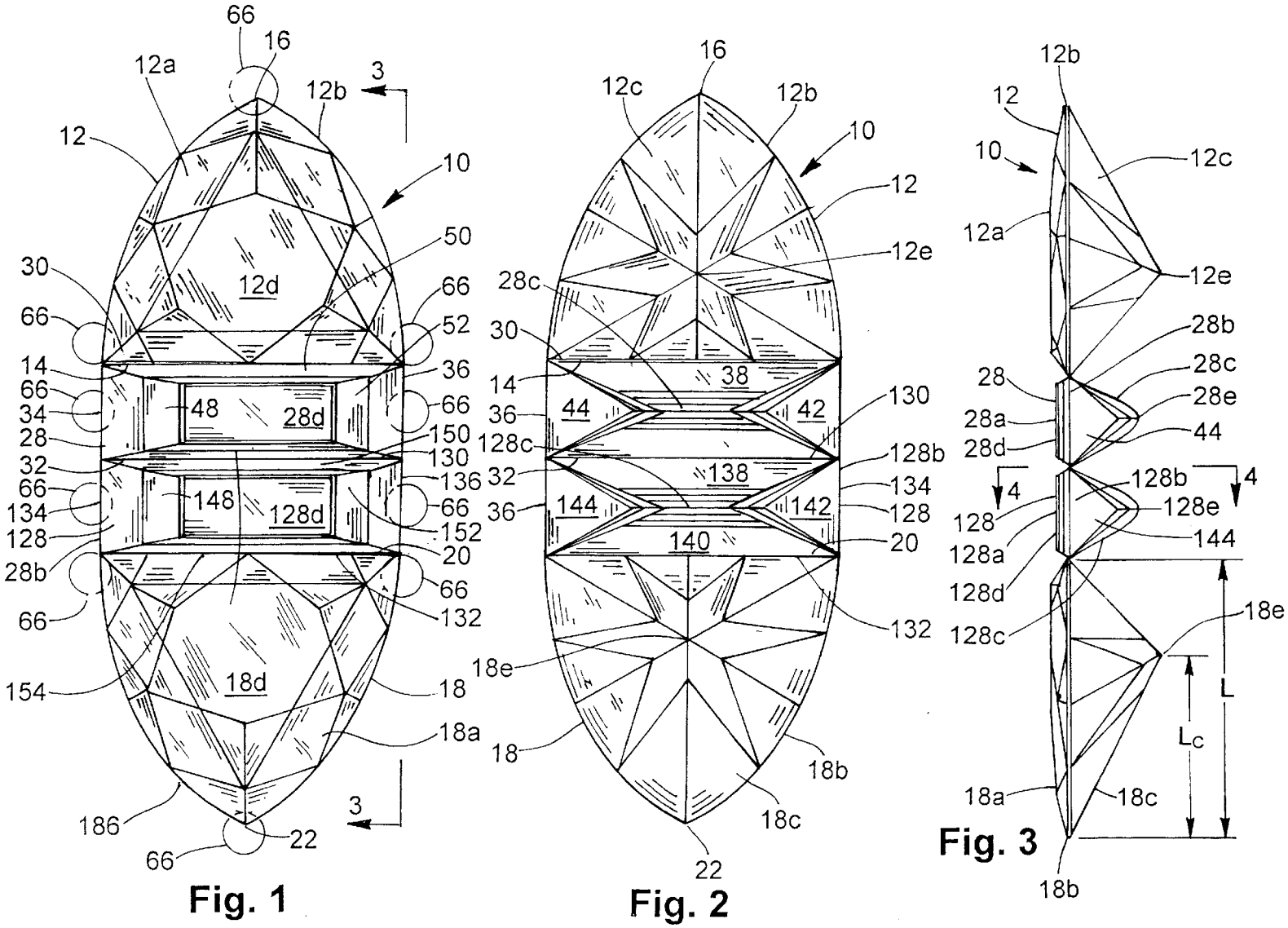
FIG. 1 is a top plan view of an assembled composite jewelry stone in accordance with a first preferred embodiment of the present invention.
FIG. 2 is a bottom plan view thereof.
FIG. 3 is an elevational view thereof taken along lines 3—3 in FIG. 1.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the composite jewelry stones in accordance with the present invention, and designated parts thereof. The terminology includes the words specifically mentioned above, derivatives thereof and words of similar import.

Referring to the drawings, wherein like numerals indicate like elements throughout, there is shown in FIGS. 1–3 a first embodiment of a composite jewelry stone 10 in accordance with the present invention. The composite jewelry stone 10 preferably has an overall appearance of a marquise stone, and includes a first half-stone 12, which is preferably a half-marquise stone, having a mating edge 14 and an opposing apex 16, and a second half-stone 18, which is preferably a half-marquise stone, having a mating edge 20 and an opposing apex 22. The mating edges 14, 20 of the first and second half-marquise stones 12, 18 preferably have a first length which is approximately equal. The first and second half-stones 12 and 18 each have a crown 12*a*, 18*a*; a girdle 12*b*, 18*b*; and a pavilion 12*c*, 18*c*. The crowns 12*a*, 18*a* each include a table facet 12*d*, 18*d*, and the pavilions 12*c*, 18*c* each include a culet apex 12*e*, 18*e*. The crowns 12*a*, 18*a* and pavilions 12*c*, 18*c* are cut in a manner which is generally known to those of ordinary skill in the art, and the particular cut is preferably a half-marquise or navette jewelry stone cut. However, it will be recognized by those skilled in the art from the present disclosure that the cut may be varied, if desired, as explained in more detail below. For example, the first and second half-stones can be trillions, or may have any other desired cut.

As shown in FIG. 3, in the preferred embodiment, the first and second half-marquise stones 12, 18 each have a length L between the mating edge 14, 20 and the opposing apex 16, 22, respectively. Preferably, the culet apex 12*e*, 18*e* is located approximately 5/10 to 6/10 the length L of each half-marquise stone 12, 18 towards the mating edge 14, 20 from the opposing apex 16, 22. The culet apex 12*e* position is shown as $L_c$ in FIG. 3. It has been found that this arrangement of the culet apex 12*e*, 18*e* for both the first and second half-marquise stones 12, 18 provides for enhanced brilliance of the mounted stones.

Still with reference to FIGS. 1–3, at least a first baguette 28 and a second baguette 128 are mounted between the first and second half-stones 12, 18. Each of the at least first and second baguettes 28, 128 have a first mating edge 30, 130 and a second, opposing, mating edge 32, 132 which have a third length which is approximately equal to the first length of the mating edges 14, 20 of the first and second half-marquise stones 12, 18. The first baguette 28 is mounted between the first and second half-stones 12, 18 such that the first mating edge 30 of the baguette 28 is generally aligned with the mating edge 14 of the first half-stone 12. The second mating edge 132 of the second baguette 128 is mounted such that it is generally aligned with the mating edge 20 of the second half-stone 18. Preferably, the first mating edge 30 of the first baguette 28 is in abutting relation to the mating edge 14 of the first half-stone 12, and the second mating edge 132 of the second baguette 128 is in abutting relationship with the mating edge 20 of the second half-stone 18. This prevents dirt and debris from becoming trapped between the mating edges 14, 30; 20, 132 of the first and second half-stones 12, 18 and the first and second baguettes 28, 128. In the first preferred embodiment, the second mating edge 32 of the first baguette 28 is generally aligned with, and more preferably, is in abutting relationship with the first mating 130 of the second baguette 128. This allows the composite jewelry stone 10 to have a larger size at reduced cost, while appearing more brilliant than stones with gaps between the mating edges.

As shown in FIGS. 1 and 2, preferably the first half-stone mating edge 14, the second half-stone mating edge 20 and the first and second mating edges 30, 130, 32, 132 of the first and second baguettes 28, 128 are approximately the same length to provide the composite stone with a continuous, generally smooth edge around its periphery, without interruption.

The first and second baguettes 28, 128 are preferably identical, and include first and second lateral sides 34, 134, 36, 136 which connect the first and second mating edges 30, 32, 130, 132, respectively. Preferably, the first and second lateral sides 34, 134, 36, 136 each have a length which is approximately equal, with the length of the lateral sides of the baguettes 28, 128 being approximately 2/10 to 3/10 of the length between the mating edges 14, 20 and the opposing apexes 16, 22 of the one of the first and second half-stones 12, 18. This relationship ensures a composite jewelry stone having a generally proportional appearance and provides greater eye appeal to a prospective purchaser.

The baguettes 28, 128 have a crown 28*a*, 128*a* with a table facet 28*d*, 128*d*, a girdle 28*b*, 128*b*, and a pavilion 28*c*, 128*c*, respectively. As shown in FIG. 3, preferably the table facets 12*d*, 18*d* of the first and second half-marquise stones 12, 18 and the table facets 28*d*, 128*d* of the first and second baguettes 28, 128 extend in generally the same plane, with some offset being permissible. However, keeping the table facets 12*d*, 18*d*, 28*d*, 128*d* of the stones in approximately the same plane provides a more uniform appearance and enhances the illusion of a single larger stone formed by the first and second half-stones 12, 18 and the baguettes 28, 128.

A detailed description of the baguettes 28, 128 follows. Since the first and second baguettes 28, 128 are preferably identical or nearly identical, the description will only be made with reference to the first baguette 28. However, the corresponding elements of the second baguette 128 have been noted on FIGS. 1–3 of the drawings with the prefix "1" for the sake of clarity and are referenced as needed in order to describe the resulting composite stone 10.

Referring now to FIGS. 1–4, the baguette 28 is cut to enhance the brilliance of the baguette 28 and reduce dark bands or zones in the composite jewelry stone 10 by creating an enhanced reflection and play of light through the baguette 28 based on the faceting on the crown 28*a* and the pavilion 28*c*. The first lateral edge 34 is located along the girdle 28*b* and the second, opposing lateral edge 36 is located opposite to the first lateral edge 34 with the first and second lateral edges 34, 36 and the first and second mating edges 30, 32 generally forming a parallelogram, which is preferably rectangular.

Figure 4:
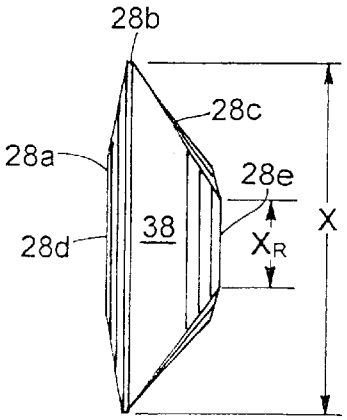
FIG. 4 is a rear elevational view of a baguette used in the composite jewelry stone in accordance with the first embodiment of the invention taken along lines 4—4 in FIG. 3.

As shown in FIGS. 2 and 4, the baguette 28 includes a first primary end pavilion facet 38 having first, second, third and fourth sides with the second and third sides being of approximately equal length. The first, second, third and fourth sides form a generally trapezoidal shape. The first side is approximately coequal in length with and adjacent to the first mating edge 30. The second and third sides extend inwardly at an acute angle to intersect at the fourth side.

The baguette 28 also includes a second primary end pavilion facet 40 having first, second, third and fourth sides. The second and third sides are approximately equal in length, with the first, second, third and fourth sides forming a generally trapezoidal shape. The first side is approximately coequal in length with and adjacent to the second mating edge 32, and the second and third sides extend inwardly at an acute angle to intersect the fourth side. The fourth sides of the first and second primary end pavilion facets 38, 40 are coextensive and form a pavilion culet ridge 28*e*.

The baguette 28 also includes a first primary lateral pavilion facet 42 having first, second and third sides, with the second and third sides being approximately equal in length. The first, second and third sides form a generally triangular shape. The first side is approximately coequal in length with and adjacent to the first lateral edge 34, and the second and third sides are generally of equal length and intersect at the pavilion culet ridge 28*e*.

The baguette 28 includes a second a primary lateral pavilion facet 44 having first, second and third sides which form a generally triangular shape. The first side is coequal in length with and adjacent to the second lateral edge 36 of the baguette 28. The second and third sides intersect at the pavilion culet ridge 28*e*.

As shown most clearly in FIGS. 2 and 4, preferably the first and second primary end pavilion facets 38 and 40 each include four facets, with the facets having edges which extend parallel to the pavilion culet ridge 28*e*. The four facets are preferably located adjacent to the pavilion culet ridge 28*e* and enhance the brilliance and light reflecting qualities of the baguette 28. Additional facets are also preferably provided on the first and second primary lateral pavilion facets 42, 44 as shown most clearly in FIGS. 2 and 3. These all combine to eliminate dark bands or zones in the baguette and at the junctures between the first and second half-marquise stones 12, 18 and the baguette 28 by reflecting light toward these areas.

Referring to FIGS. 1, 3 and 4, the crown 28*a* of the baguette 28 has a generally rectangular table 28*d* with four edges. Four primary bezel facets 48, 50, 52 and 54 are located between the girdle 28*b* and the table 28*d*. Each primary bezel facet 48, 50, 52 and 54 extends from one of the first and second mating edges 30, 32 and the first and second lateral edges 34, 36 at the girdle 28*b* to the edges of the generally rectangular table facet 28*d*. Preferably, each primary bezel facet 48, 50, 52, 54 comprises three generally trapezoidal facets, as shown in detail in FIGS. 1, 3 and 4.

As shown in FIG. 4, the mating edges 30, 32 of the baguette 28 have a length X and the pavilion culet ridge 28*e* has a length $X_R$ which is approximately 2/10 to 5/10 of the length of the mating edges 30, 32. This arrangement provides enhanced light reflection through the baguette 28 to greatly reduce or eliminate any dark bands.

Referring again to FIG. 1, prongs or hold downs 66 from a setting (not shown) are illustrated in phantom lines in order to show the mounting of the composite jewelry stone 10. Prongs or hold downs of this type are generally known to those skilled in the art, and accordingly, a description of the actual mounting of the composite marquise jewelry stone 10 is not believed to be necessary or limiting.

Figure 7:
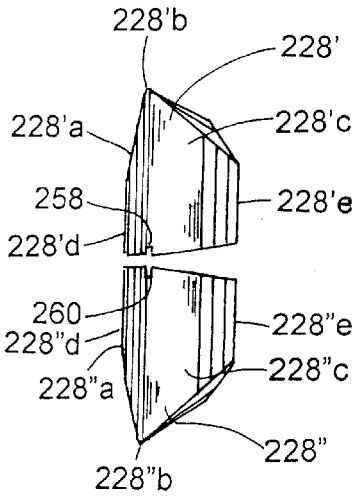
FIG. 7 is a rear elevational view, rotated 90° clockwise, of two baguettes used in the composite jewelry stone in accordance with the second preferred embodiment of the invention taken along lines 7—7 in FIG. 5.
Figure 6:
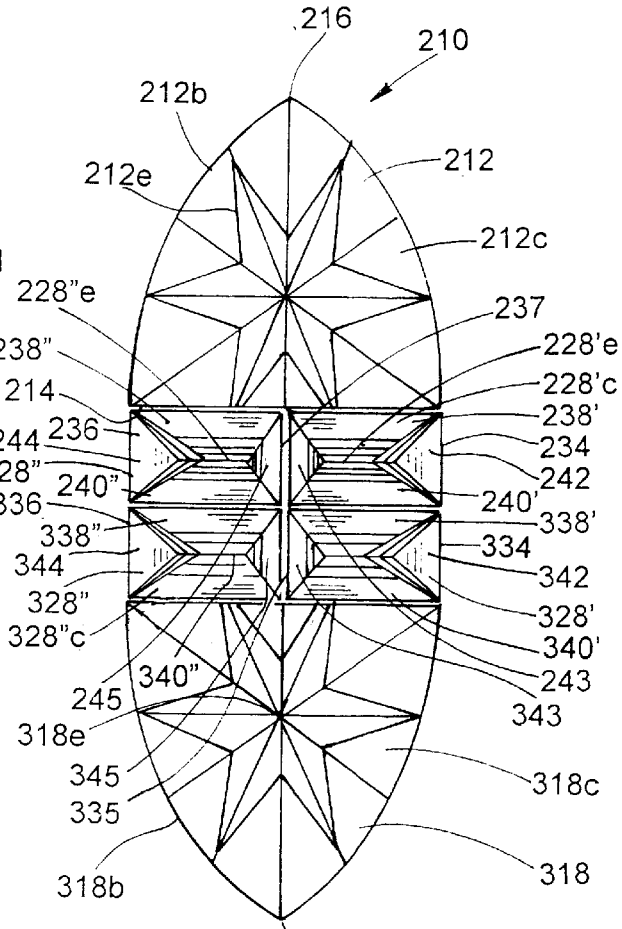
FIG. 6 is a bottom plan view thereof.
Figure 5:
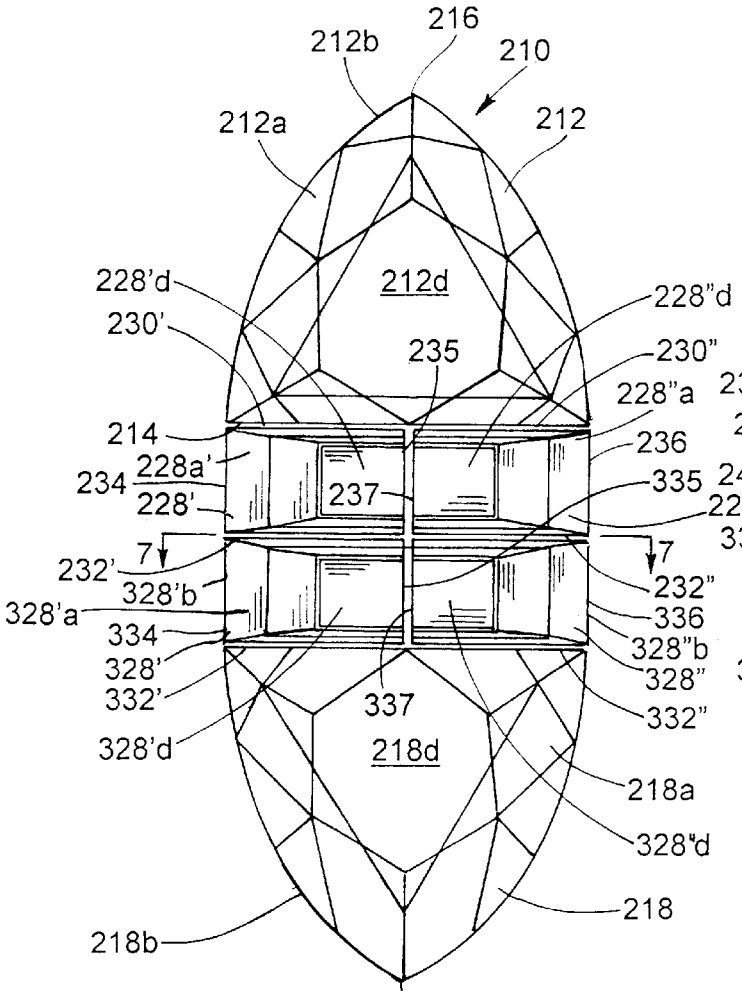
FIG. 5 is a top plan view of a second embodiment of a composite jewelry stone in accordance with the present invention.

Referring now to FIGS. 5–7, a second embodiment of a composite jewelry stone 210 is shown. The second preferred embodiment of the composite jewelry stone 210 is similar to the first preferred embodiment 10 and like elements have been identified with similar reference numerals which have been increased by 200. For example, the first half-stone 12 of the first preferred embodiment 10 of the invention is similar to the first half-stone 212 in accordance with the second preferred embodiment of the invention 210. The differences between the first and second embodiments are described in detail below.

In the second embodiment of the composite jewelry stone 210, first and second half-marquise stones 212 and 218 having the same crown and pavilion facets as disclosed in the first preferred embodiment 10 are provided. The first and second baguettes 228, 328 each comprise a first half baguette 228', 328' and a second half baguette 228", 328". The first and second pairs of half baguettes 228', 228" and 328', 328" are mounted between the first half-marquise stone 212 and the second half-marquise stone 218 in a similar manner to the first and second baguettes 28, 128 in the first embodiment.

Each of the half baguettes 228', 228", 328', 328" has a first mating edge 230', 230", 330', 330" and a second, opposing, mating edge 232', 232", 332', 332", respectively. The first half-stone mating edge 214 is in alignment with the first mating edges 230', 230" of the first pair of half baguettes 228', 228". Similarly, the second half-marquise stone mating edge 220 is in alignment with the second mating edges 332', 332" of the second pair of half baguettes 328', 328". Each of the half baguettes 228', 228", 328', 328" includes an outer lateral edge 234, 236, 334, 336 and mating internal lateral edges 235, 237, 335, 337. The mating internal lateral edges 235, 237 of the two baguettes 228', 228" are preferably in abutting alignment with each other, and the mating internal lateral edges of the second pair of half baguettes 328', 328" are in abutting alignment with each other. However, in order to clearly illustrate the stones, spaces are shown between the two baguettes 228', 228", 328", 328" in FIGS. 5–7.

The use of two baguettes 228', 228" allows the composite marquise jewelry stone 210 to be assembled using smaller baguette stones while still providing an enlarged composite jewelry stone at a reduced cost. The side view of the composite marquise jewelry stone 210 is identical to that shown in FIG. 3 in connection with the first preferred embodiment 10 since the mating internal lateral edges 235, 237, 335, 337 of the half baguettes 228', 228", 328', 328" are not visible from the side when the composite marquise jewelry stone 210 is assembled.

The half baguettes 228', 228", 328', 328" will be described in detail with reference to the first pair of half baguettes 228', 228". The second pair of half baguettes 328', 328" is generally identical to the first pair of half baguettes, and corresponding reference numbers have been provided in FIGS. 5 and 6 for the sake of clarity. As shown in detail in FIG. 7, preferably a shelf cut 258, 260 is located along the mating internal lateral edges 235, 237 of the two half baguettes 228', 228". The shelf cuts are used for invisible setting of the two baguettes 228', 228" along the mating internal lateral edges 235, 237. Shelf cuts of this type are generally known to those skilled in the art for invisible gem stone setting, for example as shown in U.S. Pat. No. 5,123,265 which is incorporated by reference as if fully set forth.

Preferably, the first pair of half baguettes 228', 228" each include a crown 228'*a*, 228"*a* having facets similar to those described in conjunction with the baguette 28 in accordance with the first preferred embodiment 10 such that when the two baguettes 228' and 228" are assembled in a setting (not shown), the assembled crowns 228'*a*, 228"*a* provide the same general appearance as the crown 28*a* of baguette 28, with the exception of the seam along the mating internal lateral edges 235, 237.

Similarly, each of the two baguettes 228', 228" includes a pavilion 228'*c*, 228"*c* which is cut such that when the two baguettes 228', 228" are assembled in the setting, the pavilions 228'*c*, 228"*c* provide a similar appearance to that provided by the baguette 28 in accordance with the first preferred embodiment 10. Specifically, is as shown in FIG. 6, primary end facets 238', 238" and 240', 240" extend from the first and second mating edges 230', 230", 232', 232" to the respective pavilion culet ridges 228'*e*, 228"*e*. A first outer primary lateral facet 242 is located on the first baguette 228', and a first outer primary facet 244 is located on the second baguette 228". Internal primary facets 243, 245, which are generally triangular in shape extend from the mating internal lateral edges 235, 237 of each baguette 228', 228" to the respective pavilion culet ridges 228'*e*, 228"*e* for each of the two baguettes 228', 228". Preferably, the additional internal primary facets which extend from the mating internal lateral edges 235, 237 comprises four facets which are generally aligned with the four facets on the first and second primary end pavilion facets 238', 238", 240', 240". This provides for increased light reflection through the baguettes 228', 228" in order to reduce or eliminate dark zones or bands caused by poor light transmittance and reflection through the baguettes 228', 228".

As shown in FIG. 7, the table facets 228'*d*, 228"*d* of the two baguettes 228', 228" are generally in the same plane with the table facets 212*d*, 218*d* of the first and second half-stones 212, 218.

The stones 212, 218, 228', 228", 328', 328" are set in a similar manner to the first embodiment 10 with the addition of an invisible gem stone setting which engages the shelf cuts 258, 260 to anchor the internal lateral edges 235, 237, 335, 337 of the half baguettes 228', 228", 328', 328".

Figure 10:
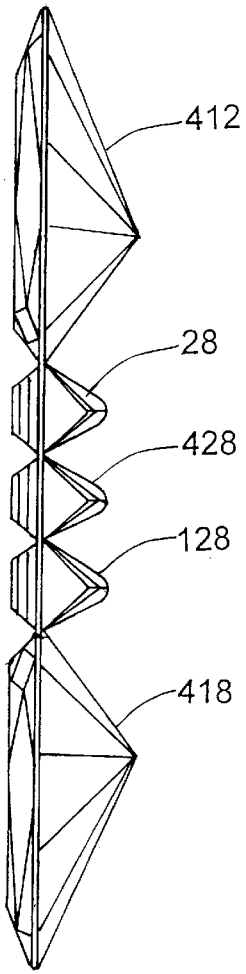
FIG. 10 is a elevational view thereof taken along lines 10—10 in FIG. 8.
Figure 9:
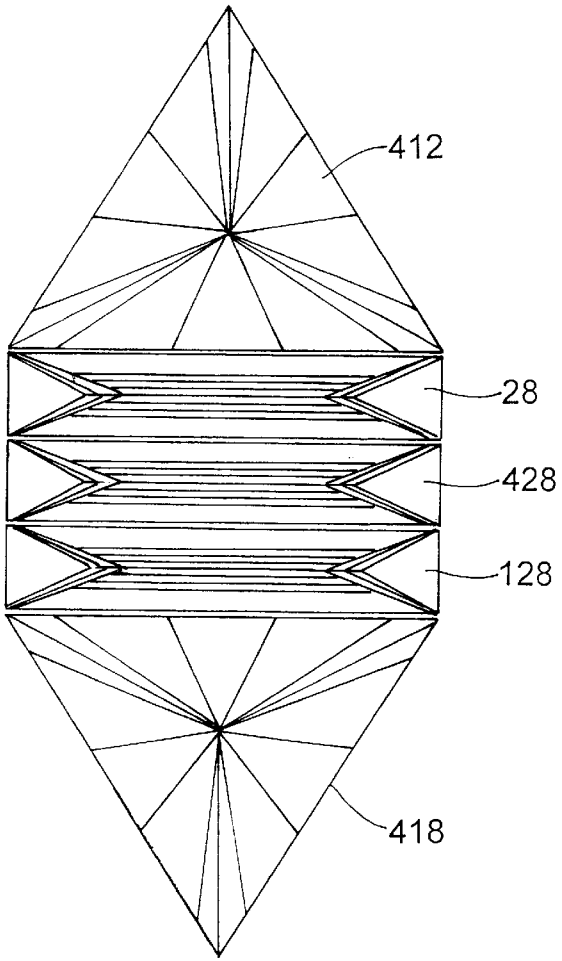
FIG. 9 is a bottom plan view thereof.
Figure 8:
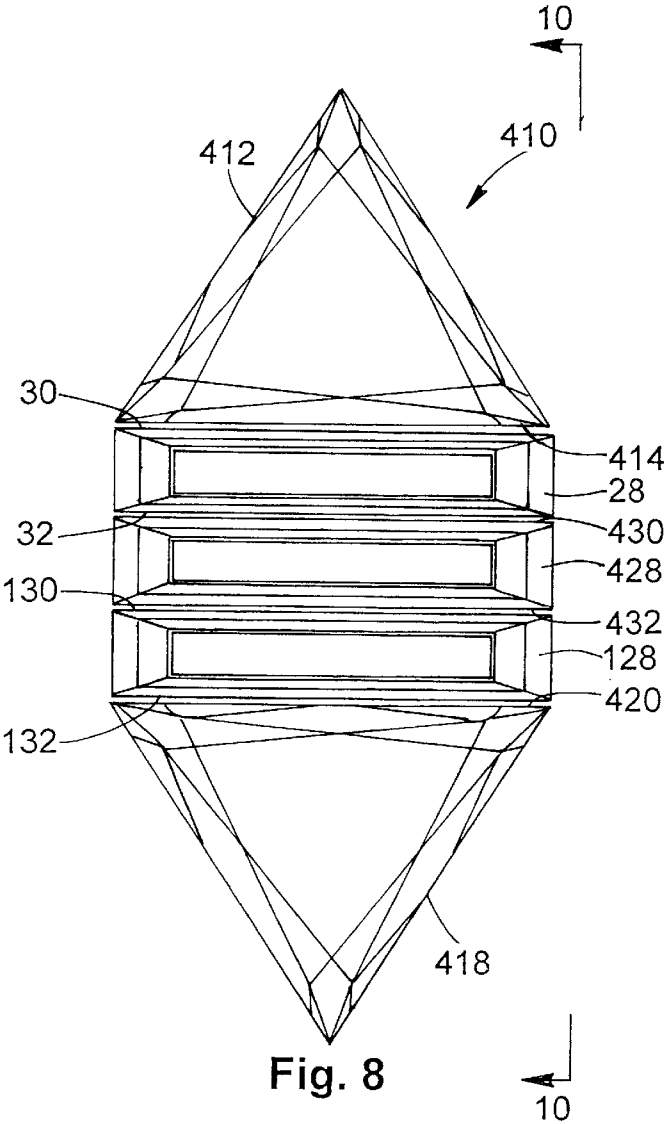
FIG. 8 is a top plan view of an assembled composite jewelry stone in accordance with a third preferred embodiment of the invention.

Referring to FIGS. 8–10, a third embodiment of a composite jewelry stone 410 is shown. The third preferred embodiment of the composite jewelry stone 410 is similar to the first preferred embodiment 10 and like elements have been identified with similar reference numerals. For example, the first half-stone 412 of the third preferred embodiment 410 of the invention is similar to the first half-stone 12 in accordance with the first preferred embodiment of the invention 10. The differences between the first and third embodiments are described in detail below.

As shown in FIGS. 8–10, the composite jewelry stone 410 includes first and second half-stones 412, 418 which are preferably trillions. As used herein, the term "half-stone" is used to refer to any type of stone which is cut such that it includes an edge which can function as a mating edge such that a similar or mirror-image stone can be assembled with the half-stone to form a composite jewelry stone. The trillions are similar to those shown in U.S. Design Pat. No. D250,100, which is incorporated herein by reference, as if fully set forth. However, it will be recognized by those skilled in the art from the present disclosure that a half-stone having any desired cut can be used. For instance, semi-navettes could be used as the half-stones.

The trillions 412, 418 each include a mating edge 414, 420 having a first length, with the first lengths being approximately equal. In the third preferred embodiment of the composite jewelry stone 410, a third baguette 428 is located between the first and second baguettes 28, 128. The third baguette includes a first mating edge 430 and a second, opposing mating edge 432. The first mating edge 430 of the third baguette is generally aligned with the second mating edge 32 of the first baguette 28. The second mating edge 432 of the third baguette 428 is generally aligned with the first mating edge 130 of the second baguette 128. Preferably, the third baguette 428 is generally identical to the first and second baguettes 28, 128, as described above. However, it will be recognized by those skilled in the art from the present disclosure that the proportions and faceting on the baguettes can be varied, if desired. It will be similarly recognized by those skilled in the art that while gaps are shown between the stones 412, 418, 28, 428, 128 in the drawings, the edges are preferably in abutting relationship in order to prevent dust and debris from becoming embedded between the stones. Thus, the spaces shown in the drawings are for the purposes of drawing clarity only.

Figure 13:
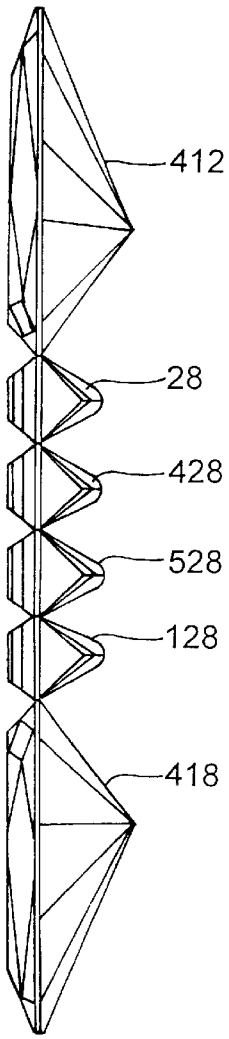
FIG. 13 is an elevational view thereof taken along lines 13—13 in FIG. 11.
Figure 12:
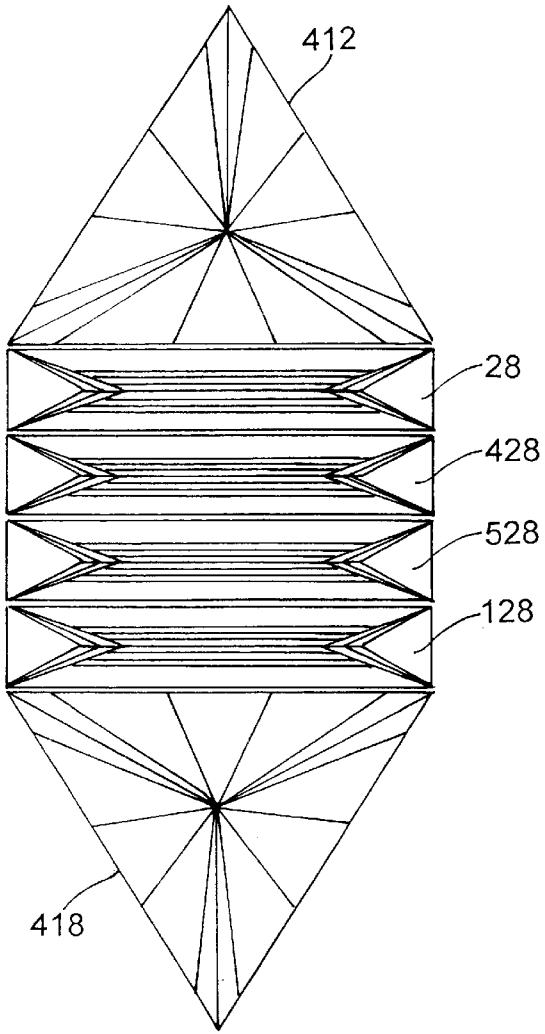
FIG. 12 is a bottom plan view thereof.
Figure 11:
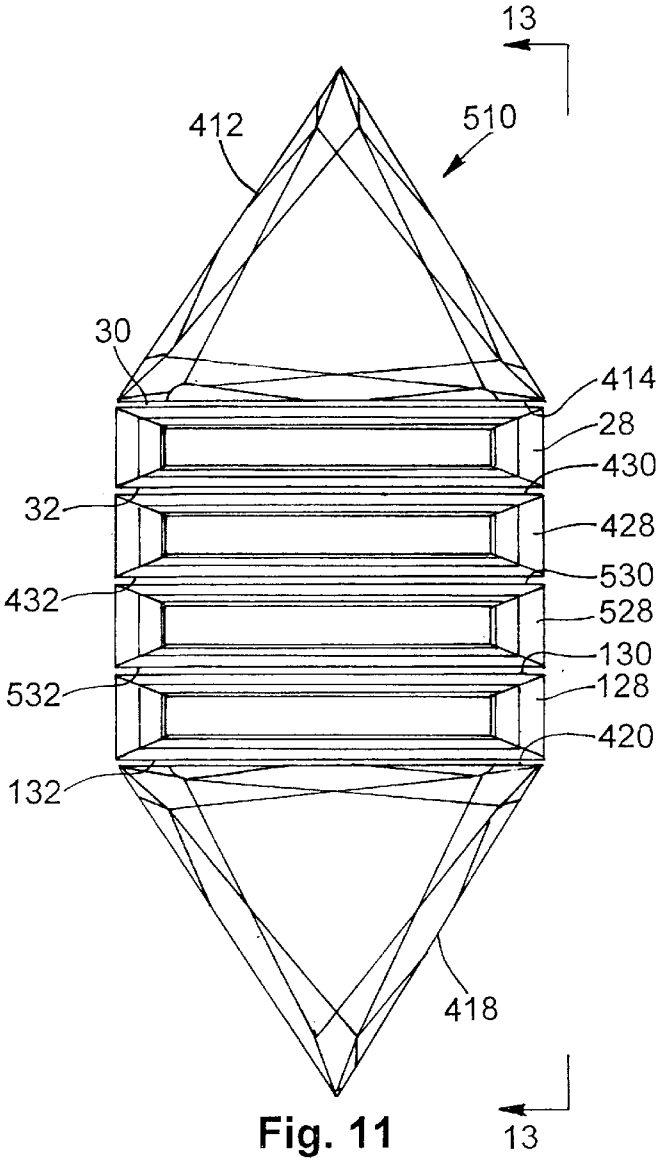
FIG. 11 is a top plan view of an assembled jewelry stone in accordance with a fourth preferred embodiment of the invention.

Referring now to FIGS. 11–13, a fourth preferred embodiment of a composite jewelry stone 510 in accordance with the present invention is shown. The fourth preferred embodiment of the invention 510 is similar to the third preferred embodiment 410 and like elements have been identified with the same reference numerals. The differences between the third and fourth embodiments 410, 510 of the composite jewelry stone in accordance with the present invention are described in detail below.

As shown in FIGS. 11–13, in the fourth preferred embodiment of the composite jewelry stone 510, a third baguette 428 and a fourth baguette 528 are located between the first baguette 28 and the second baguette 128. The third and fourth baguettes 428, 528 each have first mating edges 430, 530 and second, opposing mating edges 432, 532. The first mating edges 430, 530 and second, opposing mating edges 432, 532 have a length which is approximately equal to the first length of the mating edges 414, 420 of the first and second half-stones 412, 418. The first mating edge 430 of the third baguette 428 is generally aligned with the second mating edge 32 of the first baguette 28. The second mating edge 532 of the fourth baguette 528 is generally aligned with the first mating edge 130 of the second baguette 128. The second mating edge 432 of the third baguette 428 is generally aligned with the first mating edge 530 of the fourth baguette 528. This produces a stone having a larger overall surface area which gives the perception of more value to the purchaser. The first, second, third and fourth baguettes 28, 128, 428 and 528 are all generally identical and are cut in a similar manner to the first baguette 28, as described in detail above. However, it will be recognized by those skilled in the art from the present disclosure that different styles of baguettes could be used in a composite jewelry stone in accordance with the present invention. However, the preferred baguettes provide better light reflection in order to eliminate dark bands between the stones. It will similarly be recognized by those skilled in the art from the present disclosure that one or more of the first, second, third and fourth baguettes 28, 128, 428, 528 could comprise a first half-baguette and a second halfbaguette, with the first half-baguette having a fourth length and the second half-baguette having a fifth length such that the sum of the fourth and fifth lengths would be approximately equal to the first length, in a similar manner to the baguettes shown in connection with the second embodiment of the composite jewelry stone 210.

Figure 16:
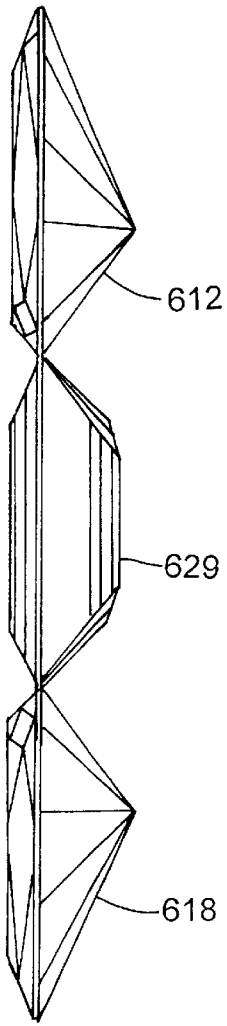
FIG. 16 is an elevational view thereof taken along lines 16—16 in FIG. 14.
Figure 15:
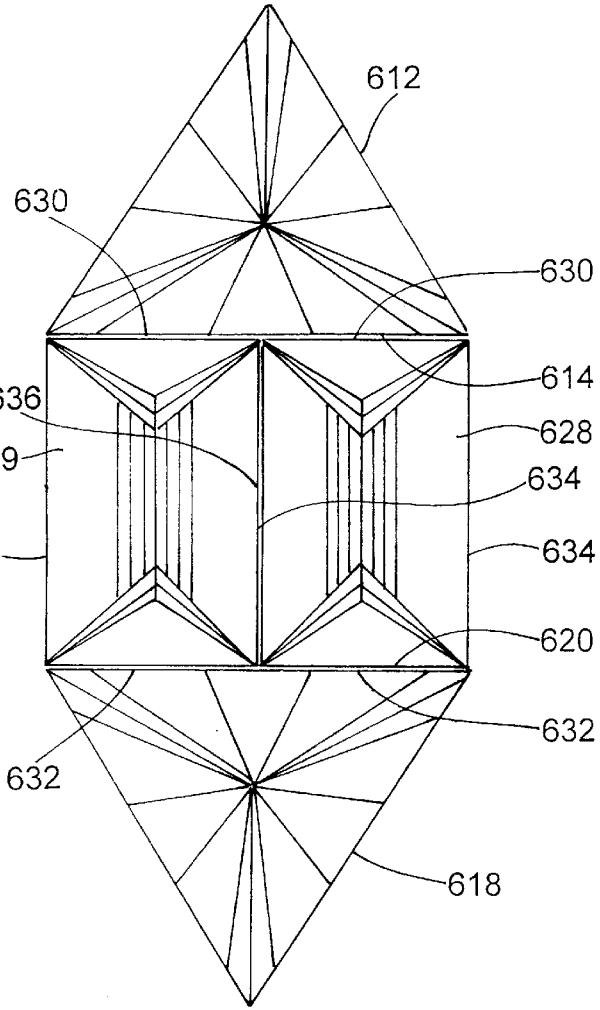
FIG. 15 is a bottom plan view thereof.
Figure 14:
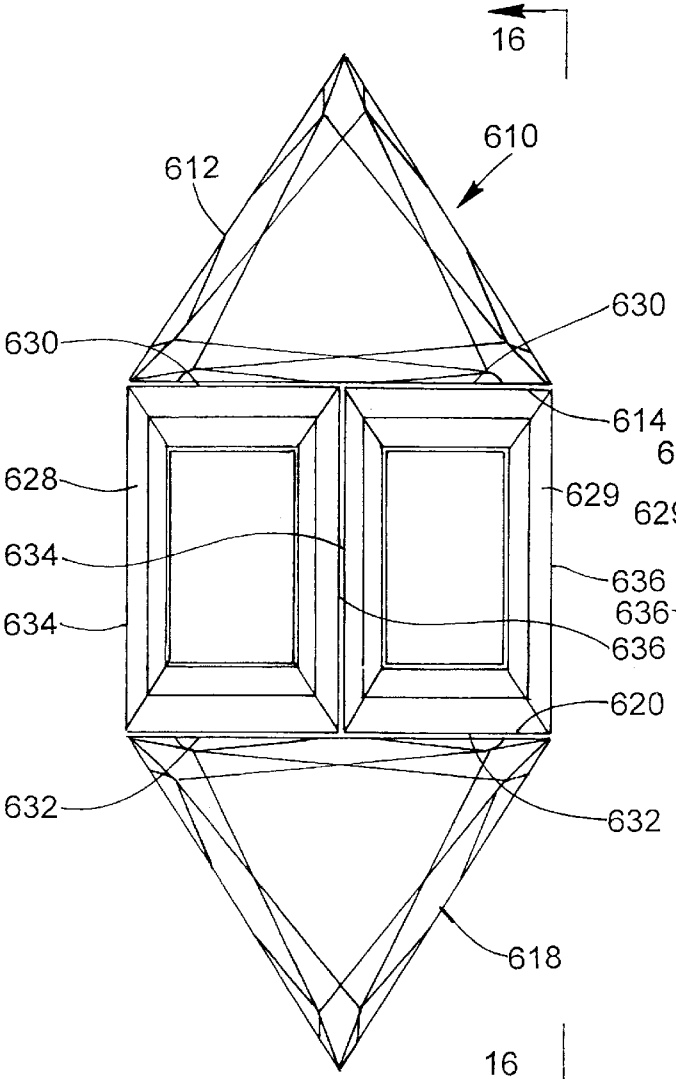
FIG. 14 is a top plan view of an assembled composite jewelry stone in accordance with a fifth preferred embodiment of the present invention.

Referring now to FIGS. 14–16, a fifth preferred embodiment of a composite jewelry stone 610 is shown. The composite jewelry stone 610 in accordance with the fifth preferred embodiment of the invention is similar to the composite jewelry stone 10 in accordance with the first preferred embodiment of the invention in that first and second half-stones 612, 618 are provided, with each half-stone 612, 618 being a trillion. However, it will be recognized by those skilled in the art from the present disclosure that other styles of half-stones could be used in conjunction with the fifth preferred embodiment of the invention. Each half-stone 612, 628 includes a mating edge 614, 620, with the mating edges being of approximately equal length. At least first and second baguettes 628, 629 are mounted between the first and second half-stones 612, 618. Each of the at least first and second baguettes 628, 629 has a first mating edge 630 and a second opposing mating edge 632 which have a third length. The sum of the third lengths of the at least first and second baguettes 628, 629 is approximately equal to the first length of the mating edges of the first and second half-stones 612, 618. The first mating edges 630 of the at least first and second baguettes 628, 629 are generally aligned with the mating edge 614 of the first half-stone 612. The second mating edges 632 of the at least first and second baguettes 628, 629 are generally aligned with the mating edge 620 of the second half-stone 618. The first and second baguettes 628, 629 each include first and second opposing lateral edges 634, 636. The second lateral edge 636 of the first baguette 628 is preferably aligned with and in abutting contact with the first lateral edge 634 of the second baguette 629.

The at least first and second baguette 628, 629 preferably include similar crown and pavilion facets to the baguette 28 described above in conjunction with the first preferred embodiment of the invention. However, in the fifth preferred embodiment of the invention the baguettes are aligned such that the longer edges extend between the first and second half-stones 612, 618. Accordingly, a detailed description of the crown and pavilion facets has been omitted for the sake of brevity, but is not considered to be limiting. It will be recognized by those skilled in the art from the present disclosure that the arrangement of the crown and pavillion facets of the at least first and second baguettes can be varied, as desired.

Figure 19:
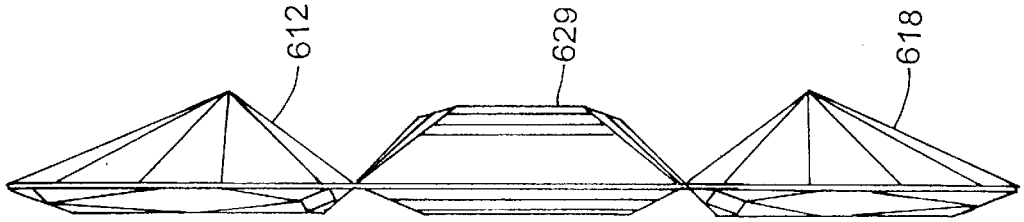
FIG. 19 is an elevational view thereof taken along lines 19—19 in FIG. 17.
Figure 18:
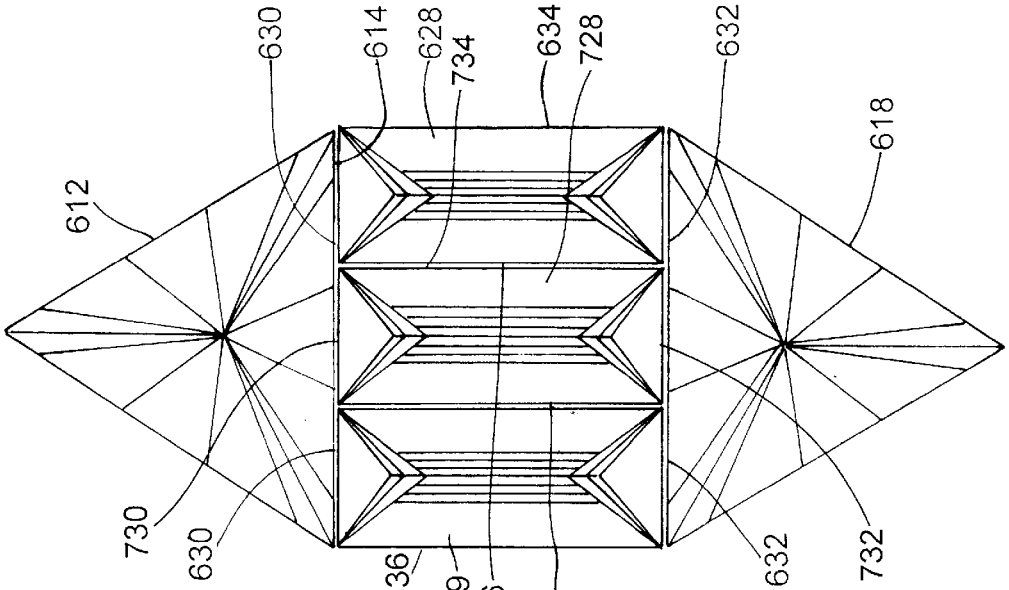
FIG. 18 is a bottom plan view thereof.
Figure 17:
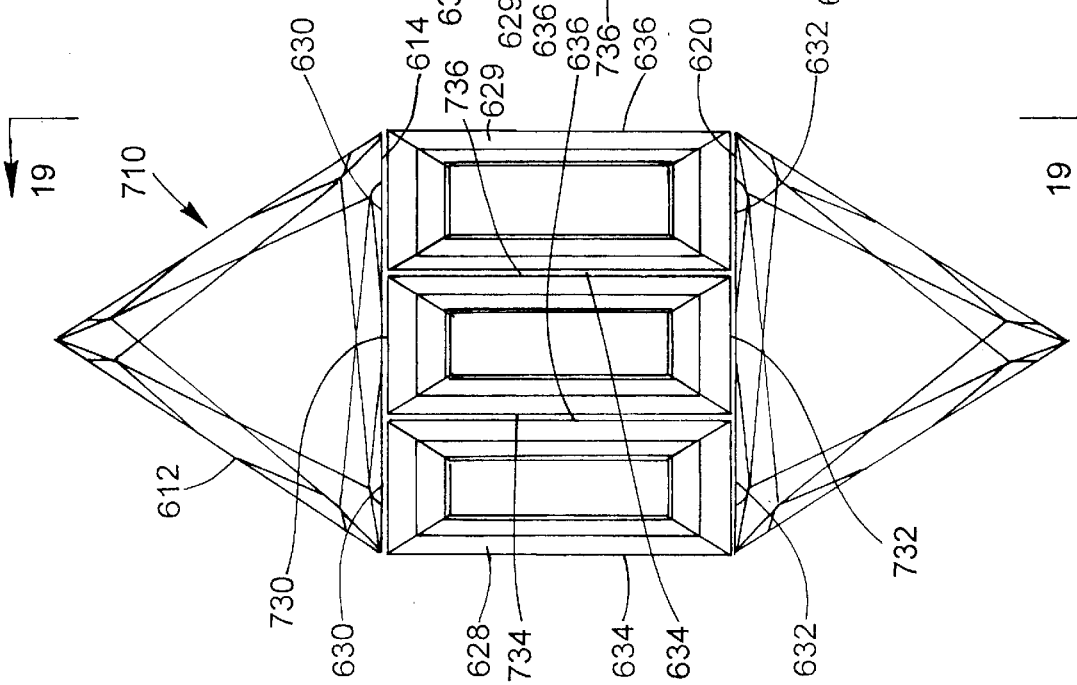
FIG. 17 is a top plan view of an assembled composite jewelry stone in accordance with a sixth preferred embodiment of the present invention.

Referring now to FIGS. 17–19, a sixth preferred embodiment of the composite jewelry stone 710 is shown. The sixth preferred embodiment of the composite jewelry stone 710 is similar to the fifth preferred embodiment, and like elements have been identified with the same reference numerals. The differences between the fifth and sixth embodiments of the composite jewelry stone 610, 710 are described in detail below.

As shown in FIGS. 17 and 18, in the sixth preferred embodiment of the composite jewelry stone 710, first, second and third baguettes 628, 629 and 728 are provided. Each of the first, second and third baguettes has a first mating edge 630, 730 and a second mating edge 632, 732, which each have a third length. The third length is approximately equal to one-third of the first length of the mating edges 614, 620 of the first and second half-stones 612, 618. The first, second and third baguettes 628, 629, 728 are preferably cut in a similar manner to the baguette 28 of the first embodiment 10. The baguettes 628, 629, 728 are positioned such that lateral sides 634, 636, 734, 736 of the first, second and third baguettes 628, 629, 728 are longer than the mating edges 630, 632, 730, 732. This can be used to provide a stone with a larger appearance.

Figure 22:
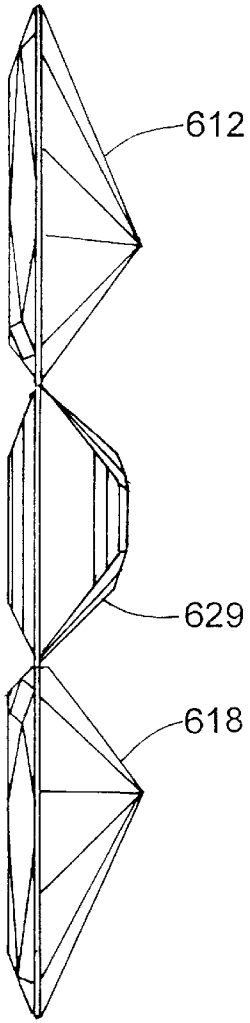
FIG. 22 is an elevational view thereof taken along lines 22—22 in FIG. 20.
Figure 21:
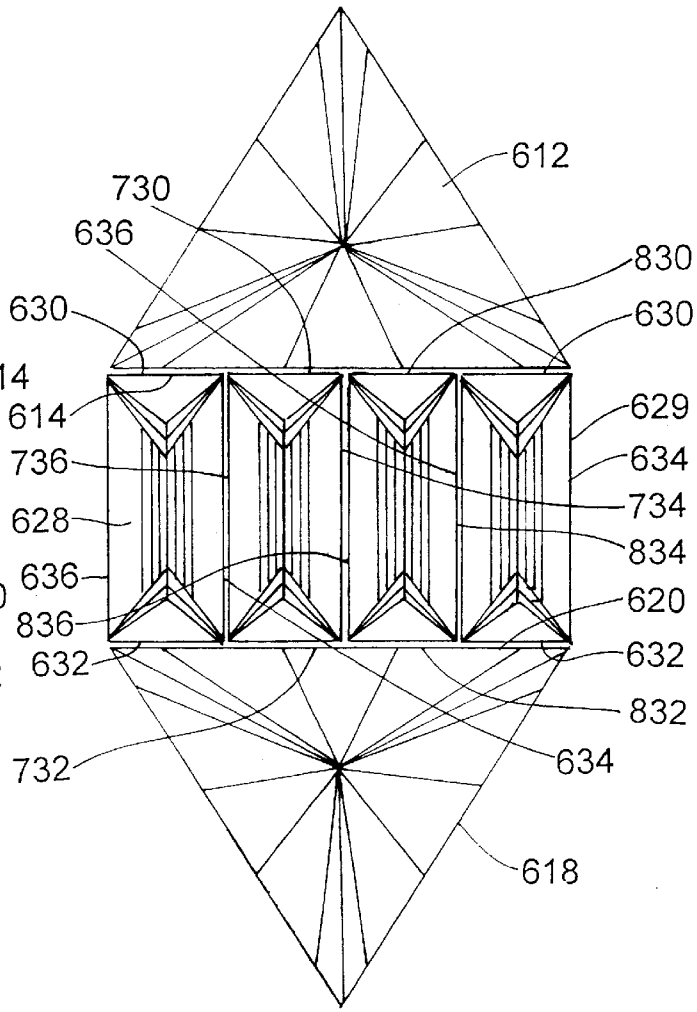
FIG. 21 is a bottom plan view thereof.
Figure 20:
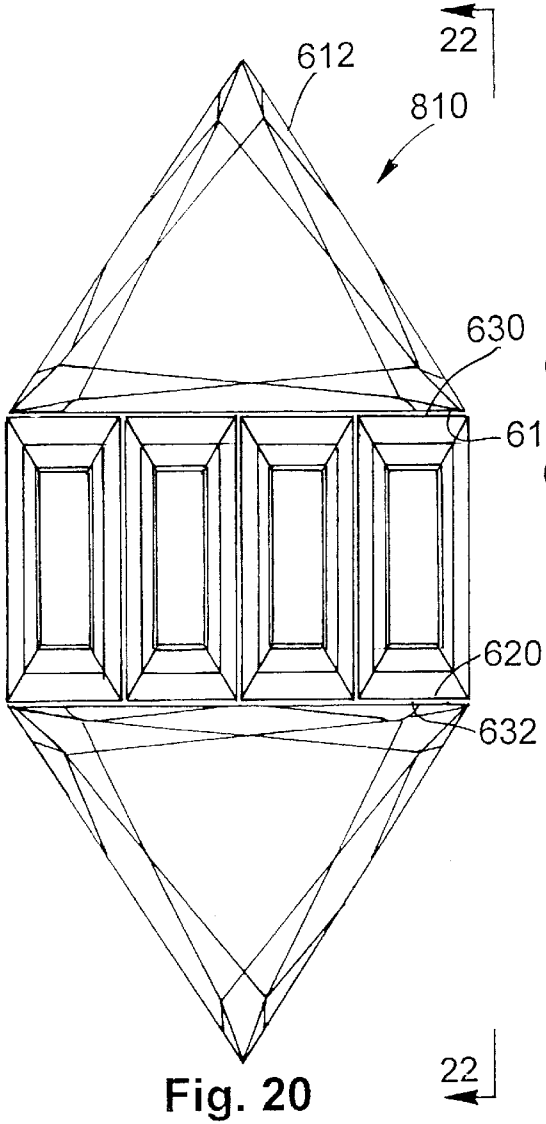
FIG. 20 is a top plan view of an assembled composite jewelry stone in accordance with a seventh preferred embodiment of the present invention.

Referring now to FIGS. 20–22, a seventh preferred embodiment of a composite jewelry stone 810 is provided. The seventh preferred embodiment of the jewelry stone 810 is similar to the fifth and sixth preferred embodiments 610, 710, and like elements have been identified with the same reference numerals. The differences between the seventh embodiment of the composite jewelry stone 810 and the sixth embodiment of the composite jewelry stone 710 are explained in detail below.

As shown in FIGS. 20–22, in the seventh preferred embodiment of the composite jewelry stone 810, first, second, third and fourth baguettes 628, 629, 728, 828 are provided. The third length of the first and second opposing mating edges 630, 632, 730, 732, 830, 832 is approximately equal to one-fourth of the first length of the mating edges 614, 620 of the first and second half-stones 612, 618. The first, second, third and fourth baguettes 628, 629, 728, 828 are cut in a similar matter to the baguette 28 used in the composite jewelry stone 10 in accordance with the first preferred embodiment of the invention as described above. However, the baguettes are oriented such that the laterally positioned sides are longer than the mating edges.

It will be recognized by those of ordinary skill in the art that the present invention provides a composite jewelry stone 10, 210, 410, 510, 610, 710, 810 having a greater size than the known composite jewelry stones which were previously assembled from only first and second half-stones by utilizing at least two baguettes while maintaining the same general overall proportions of the stone. It will similarly be recognized that the at least two baguettes can each comprise half baguettes. Additionally, based on the cutting of the baguette and the inclusion of a pavilion culet ridge, enhanced light reflecting and transmitting qualities are provided in the baguette to reduce or eliminate dark bands or zones and enhance the overall eye appeal of the composite jewelry stone 10, 210, 410, 510, 610, 710, 810.

The jewelry stone 10, 210, 410, 510, 610, 710, 810 in accordance with the present invention can be used in various types of jewelry, such as rings, pins, necklaces, earrings and bracelets, or any other type of setting. Additionally, the invention is not limited to the types of first and second half-stones which are used in conjunction with the baguettes 28, 128, 428, 528, 629, 728, 828 or multiple baguettes 228', 228", 328', 328".

It will be appreciated by those skilled in the art that changes could be made to the preferred embodiments of the invention described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A composite jewelry stone comprising:

a first half-stone having a mating edge with a first length;

a second half-stone having a mating edge with a second length which is approximately equal to the first length;

at least a first baguette and a second baguette mounted between the first and second half-stones, each of the at least first and second baguettes having a first mating edge and a second opposing mating edge which have a third length that is approximately equal to the first length, the first mating edge of the first baguette being generally aligned with the mating edge of the first half-stone, the second mating edge of the second baguette being generally aligned with mating edge of the second half-stone, and the second mating edge of the first baguette facing the first mating edge of the second baguette.

2. The composite jewelry stone of claim 1 wherein the second mating edge of the first baguette is generally aligned with the first mating edge of the second baguette.

3. The composite jewelry stone of claim 1 wherein the first baguette and the second baguette each comprise a first half baguette and a second half baguette, each of the first half baguettes having a fourth length and each of the second half baguettes having a fifth length, the sum of the fourth and fifth lengths being approximately equal to the first length.

4. The composite jewelry stone of claim 1 further comprising a third baguette having a first mating edge and a second, opposing mating edge located between the first and second baguettes, the first mating edge of the third baguette being generally aligned with the second mating edge of the first baguette, and the second mating edge of the third baguette being generally aligned with the first mating edge of the second baguette.

5. The composite jewelry stone of claim 4 wherein the first, second and third baguettes each comprise a first half baguette and a second half baguette, each of the first half baguettes having a fourth length and each of the second half baguettes having a fifth length, the sum of the fourth and fifth lengths being approximately equal to the first length.

6. The composite jewelry stone of claim 1 wherein each baguette includes a table facet and a pavilion having a culet ridge, with the culet ridge extending generally parallel to the first and second mating edges.

7. The composite jewelry stone of claim 1 wherein the half-stones are half-marquise stones.

8. The composite jewelry stone of claim 1 wherein a third baguette and a fourth baguette are located between the first baguette and the second baguette, the third and fourth baguettes each having a first mating edge and a second, opposing mating edge, the first mating edge of the third baguette being generally aligned with the second mating edge of the first baguette, the second mating edge of the fourth baguette being generally aligned with the first mating edge of the second baguette, and the second mating edge of the third baguette being generally aligned with the first mating edge of the fourth baguette.

9. The composite jewelry stone of claim 8 wherein each half-stone includes a table facet located generally in a first plane, and each baguette includes a baguette table facet, and the baguette table facets are located generally in the first plane.

10. The composite jewelry stone of claim 8 wherein the half-stones are half marquise stones.

11. The composite jewelry stone of claim 8 wherein the half-stones are trillions.

12. The composite jewelry stone of claim 8 wherein the first, second, third and fourth baguettes each comprise a first half baguette and a second half baguette, the first half baguette having a fourth length and the second half baguette having a fifth length, the sum of the fourth and fifth lengths being approximately equal to the first length.

13. A composite jewelry stone comprising:

a first half-stone having a mating edge with a first length;

a second half-stone having a mating edge with a second length which is approximately equal to the first length;

at least first and second baguettes mounted between the first and second half-stones, each of the at least first and second baguettes having a first mating edge and a second, opposing mating edge, each of which has a third length, the sum of the third lengths of the at least first and second baguettes being approximately equal to the first length, the first mating edges of each of the at least first and second baguettes being generally aligned with the mating edge of the first half-stone, the second mating edges of each of the at least first and second baguettes being generally aligned with the mating edge of the second half-stone.

14. The composite jewelry stone of claim 13 wherein there are first, second and third baguettes, and the third length of the first, second and third baguettes is approximately equal to one-third of the first length.

15. The composite jewelry stone of claim 13 wherein there are first, second, third and fourth baguettes, and the third length is approximately equal to one-fourth of the first length.

16. The composite jewelry stone of claim 13 wherein the first and second half-stones are trillions.

* * * * *